United States Patent [19]

Wright

[11] 4,022,351

[45] * May 10, 1977

[54] FOAM DISPENSER

[76] Inventor: Hershel Earl Wright, 12 Eighth Drive, Decatur, Ill. 62521

[ * ] Notice: The portion of the term of this patent subsequent to Feb. 10, 1993, has been disclaimed.

[22] Filed: Apr. 3, 1975

[21] Appl. No.: 564,700

[52] U.S. Cl. ..... 222/145; 222/190; 222/212; 239/343

[51] Int. Cl.[2] ..... B65D 37/00

[58] Field of Search ..... 222/190, 145, 95, 189, 222/207, 211, 212, 402.18; 239/343, 327

[56] References Cited

UNITED STATES PATENTS

| | | | |
|---|---|---|---|
| 3,010,613 | 11/1961 | Stossel | 222/190 |
| 3,308,993 | 3/1967 | Bruno | 222/190 X |
| 3,422,993 | 1/1969 | Boehm et al. | 222/190 |
| 3,471,064 | 10/1969 | Micallef | 222/190 X |
| 3,606,963 | 9/1971 | Marand | 222/402.18 X |
| 3,622,049 | 11/1971 | Thompson | 222/190 |
| 3,628,700 | 12/1971 | Dodoghue | 222/207 |
| 3,709,437 | 1/1973 | Wright | 222/190 X |
| 3,937,364 | 2/1976 | Wright | 222/211 X |

*Primary Examiner*—Drayton E. Hoffman
*Assistant Examiner*—Charles A. Marmor
*Attorney, Agent, or Firm*—Cohn, Powell & Hind

[57] ABSTRACT

This foam dispenser includes a flexible container for foamable liquid, having a discharge opening at the upper end. A porous member is housed in the discharge opening and a conduit communicating with said porous member extends downwardly into the interior of the container. A flow directing valve system within the conduit determines the path of air and liquid through the conduit and the porous member during manual pressurization and depressurization of the container. The foamable liquid and air are isolated from each other by a bag member disposed within the container.

14 Claims, 2 Drawing Figures

Fig. I
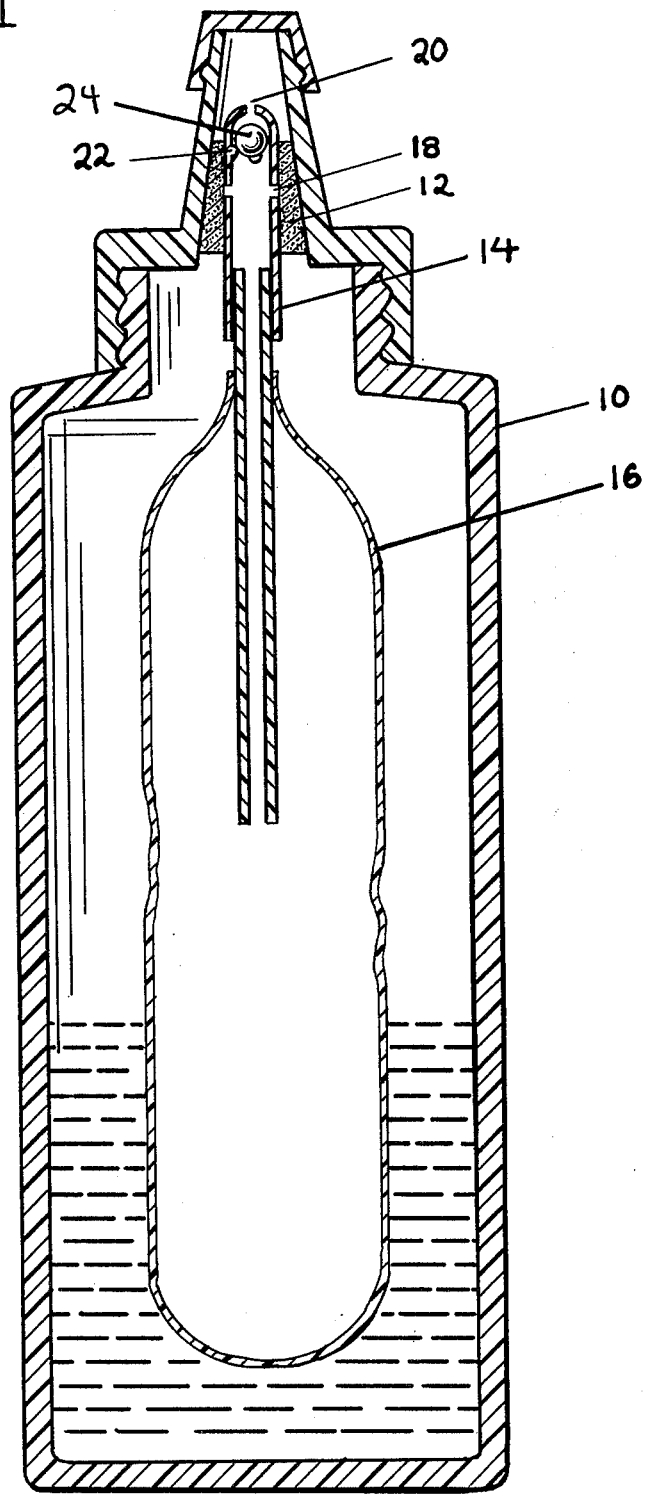

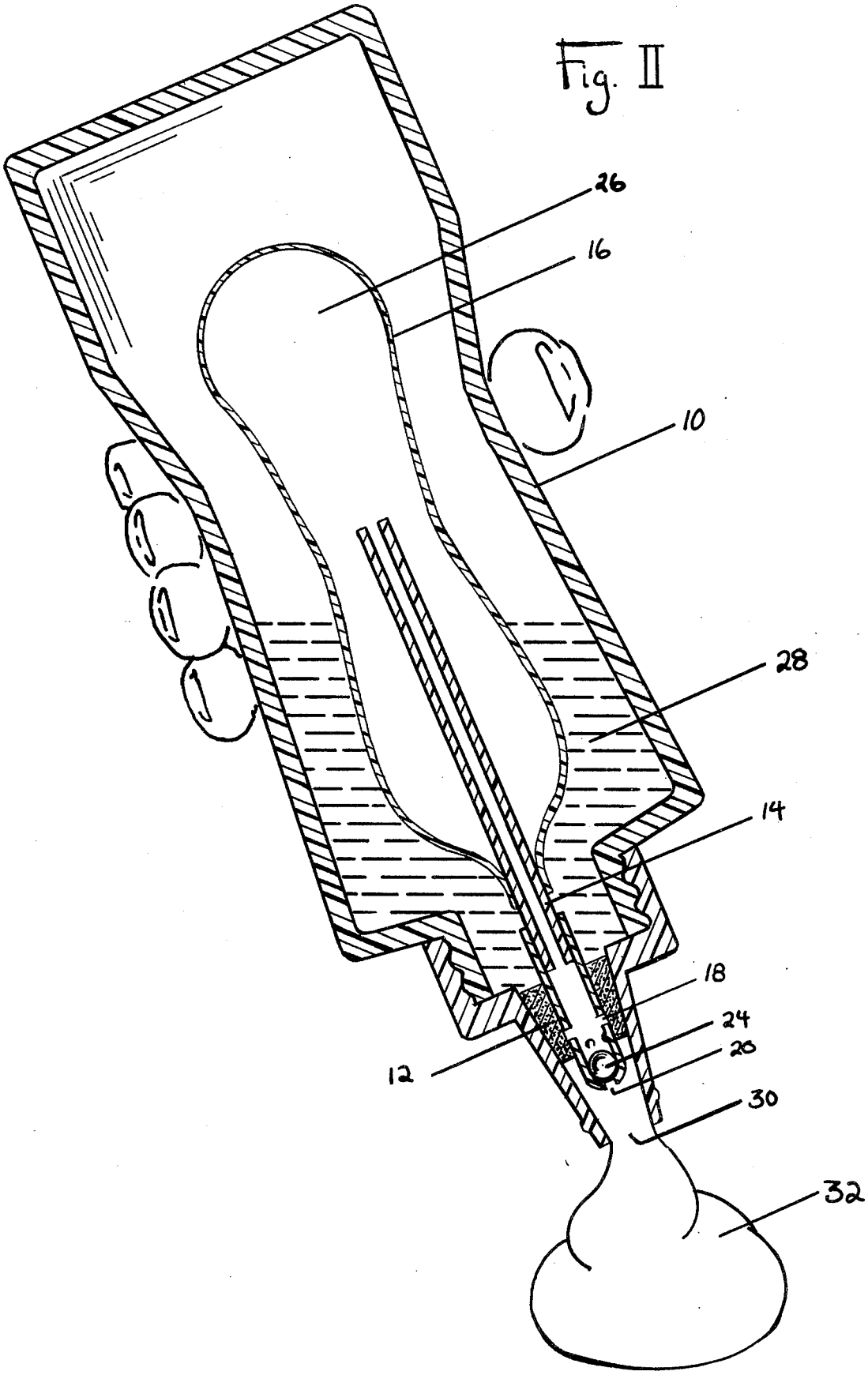
Fig. II
26
16
10
28
14
18
24
20
12
30
32

FOAM DISPENSER

RELATED U.S. APPLICATION DATA

This application is related to U.S. application Ser. No. 564,701 filed Apr. 3, 1975 and issued on Feb. 10, 1976 as U.S. Pat. No. 3,937,364.

BACKGROUND OF THE INVENTION

Recent trends in the merchandising of consumer goods have indicated the need for dispensing devices capable of dispensing cleaning and waxing products; cosmetics and toiletries and food stuffs. These dispensing devices must be economical to manufacture and efficient in operation to provide an advantage to the consumer over previous packaging techniques. It is also important with respect to some products that the container be capable of producing a foam when the container is in the inverted position. The advent of self-contained pressurized dispensing devices are generally capable of operation in the inverted position but has introduced the requirement for a container strong enough to withstand the rather high internal pressures thereby adding substantially to the manufacturing costs of such dispensing devices. In addition, such pressurized dispensing devices have the disadvantage that the gas used in effecting the formation of foam and discharge thereof does not replenish itself, thus limiting the useful life of the dispensing device.

As a result of the problems associated with pressurized dispensing devices, several types of foaming devices using flexible or plastic containers, relying on manual pressure, were developed. Unfortunately most, if not all of the more efficient devices, would work in only one position, generally upright. However, some foaming devices using flexible containers were developed which could operate in an inverted position such as the foam dispenser which is shown and described in U.S. Pat. No. 3,422,993 to G. L. Boehm. Although some of these systems appear to create a good foam, a serious limitation was inherent if the bottle was shaken prior to use or merely by repeated use. More specifically the shaking of the foam dispenser or repetitive uses tends to create a foam within the bottle particularly within the area of air withdrawal from the bottle itself causing disruption of the foaming process and inadequate foam. Consequently there is a great need for a foaming device which can be used in the inverted position and which will operate effectively to produce a quality foam irrespective of shaking or the number of repetitive uses.

SUMMARY OF THE INVENTION

The present invention relates generally to foaming devices and more specifically to manually operated foaming devices which can be used in the inverted position.

Accordingly, it is a primary object of this invention to provide a foaming device which can be operated manually in the inverted position.

It is another object of this invention to provide a foaming device which will produce a quality form irrespective of whether the container is shaken or the number of repetitive uses.

It is a further object of this invention to provide a manually operable foaming device having a rapid container recovery.

It is another object of this invention to provide a manually pressure-operated foaming device having a valving system which will permit the production of a uniform foam when the container is in the inverted position. By inverted is meant the container discharge is directed downwardly.

Further objects and advantages of my invention, together with the organization and manner of operation thereof may best be understood by reference to the following description of the preferred embodiment of the invention when taken in conjunction with the accompanying drawings, wherein like reference numerals identify like elements throughout the two views.

BRIEF DESCRIPTION OF THE DRAWINGS

FIG. 1 is a longitudinal sectional view of the preferred foam dispenser constructed in accordance with the present invention; and FIG. 2 is the foam dispenser of FIG. 1 after being squeezed while in an inverted position.

DESCRIPTION OF THE PREFERRED EMBODIMENT

Referring to the drawings and more particularly FIG. 1, there is schematically shown a foam dispenser comprising a container 10, a porous member 12 and a conduit 14 extending longitudinally through the porous member 12 into the inside of container 10. Surrounding and integrally attached to conduit 14 is a bag member 16. At the upper end of conduit 14 are apertures 18, aperture 20 and projections 22 positioned within conduit 14 and serving as a shelf for ballcheck 24 which provide a valve system.

The operation of the foam dispenser of FIG. 1 can be more readily appreciated by reference to FIG. 2 illustrating container 10 substantially inverted and manually pressurized. As a result of the inversion and/or pressure, ballcheck 24 has moved towards and is now in sealing engagement with aperture 20 causing air 26 coming from within bag member 16 to be directed through aperture 18 into the porous member 12. As is shown in FIG. 2, the foamable solution 28 is in direct contact with the porous member 12 and the application of manual pressure to container 10 has not only resulted in a pressure on bag 16 forcing air into the porous member 12 but also causes foamable solution to be forced directly into the porous member to intermix with the air entering from the conduit to produce a foam 32 which is forced outwardly through discharge opening 30.

Upon release of the manual pressure by either removal or relaxation of the fingers, the ballcheck 24 disengages aperture 20 which provides an air re-entry opening, permitting air to return rather rapidly around the ballcheck and projections and through conduit 14 into the bag member 16. It is not necessary for the container to be upright for this air returning operation to occur.

The valve system required is one that will close the aperture of the conduit which leads to the container discharge when the container is either pressurized or inverted thereby directing the air within the bag member through the conduit and into the porous member. In addition the valve system must operate to provide a rapid air return to restore the shape of the container and to inflate the bag. The preferred system is a ballcheck operating in the manner shown and described but it is obvious that any valve system which will perform the described function is within the scope of the present invention.

The bag member serves to isolate the air from the foamable solution. As a result fouling of the conduit by foaming taking place within the body of the container does not occur. Consequently if the bottle is shaken prior to use, the air supply through the conduit is not contaminated. Furthermore any contamination which might result from repetitive use is eliminated. Contamination of the air by foam within the bottle generally results in sporadic and low quality foam. For effective operation, the bag must be flexible to permit deflation and inflation. Any material fulfilling this requirement and compatible with the foamable solution will suffice.

It is preferred that the conduit, extending from the porous member into the container, project to some extent into the bag. This will serve to minimize re-entry of any liquid that may condense within the bag member back into the conduit during a subsequent inverted foaming operation. More specifically such liquid would tend to collect around the outer portion of the conduit as the bag deflates.

The conduit may be composed of any suitable material compatible with the system and may be of any cross-sectional shape such as round, square and the like. It is generally preferred that the conduit extend through the porous member but it is also obvious that the device will still operate in the manner described even though the conduit does not extend completely through the porous member as long as the distance between the conduit opening leading to the discharge area and the upper surface of the porous member is not so great to substantially inhibit the movement of air returning to the unit.

The porous member can be any material having numerable tortuous paths to allow for intimate mixing of the foamable solution and air. Although the material making up the porous member can be fairly resilient, a more or less noncompressible or rigid material is generally preferred for optimum uniformity of foam due to the reduced compression of the porous channels within the porous material. Noncompressible porous materials may be made from foraminous volcanic glass material, sintered glass of the type used in filters, or noncompressible plastics such as porous polyethylene, polypropylene, nylon, rayon, etc.

For optimum operation of the foam dispenser the porosity and/or rigidity of the porous member is very important. More specifically the porous member will be receiving foamable solution directly from the container at time of pressurization. Consequently the porosity should be such to pass liquid through the porous member at a uniform and optimum rate for mixing with little or no leakage of foamable solution when the container is upended prior to pressurization. The rigid porous materials operate more effectively because they are not subject to significant compressiblity which tends to reduce fluid passage and particularly the passage of the foamable solution.

The container proper may be constructed of any material capable of containing foamable material and air. Generally the pressure used to force the air and foamable solution together as described will result from manually squeezing the container. In this instance the container material preferred would be that which is flexible and elastic such as many of the presently known plastics.

While preferred embodiments of the present invention have been shown and described, it will be obvious to those skilled in the art that changes and modifications may be made therein without departing from the invention in its broader aspects.

What is claimed is:

1. A foam dispensing device comprising:

a. a flexible container for holding a foamable liquid having a dishcarge port, b. a porous member separating the area adjacent said discharge port and the inside of said container, c. air bag means disposed within the container for holding an air supply isolated from said liquid, d. conduit means communicating between the porous member and the air bag means, and including means permitting an air flow into the air bag means, and e. a flow directing means associated with the conduit means for directing air from inside the air bag means through the conduit means and into the porous member while the foamable liquid is being directed into the porous member from inside of said container during pressurization of the container.

2. The foam dispenser according to claim 1, wherein:

f. the porous member is substantially noncompressible.

3. The foam dispenser according to claim 1, wherein:

f. the conduit means extends at least partly through said porous member and communicates transversely with the porous member.

4. The foam dispenser according to claim 1, wherein:

f. the flow directing means includes movable valve means cooperating with the means permitting an air flow into the air bag means and actuated during depressurization of the container to permit rapid air re-entry into the air bag means.

5. The foam dispenser according to claim 1, wherein:

f. the flow directing means includes movable valve means cooperating with the means permitting an air flow into the air bag means and actuated during pressurization to direct air from the conduit means into the porous member.

6. The foam dispenser according to claim 1, wherein:

f. the conduit means extends at least partly through said porous member and includes an air re-entry, g. the flow directing means includes movable valve means actuated during depressurization of the container to substantially open the air re-entry and admit air into the air bag means.

7. The foam dispenser according to claim 1, wherein:

f. the conduit means extends at least partly through said porous member and includes an air re-entry, and g. the flow directing means includes movable valve means actuated during pressurization of the container to substantially close the air re-entry and direct fluid transversely into the porous member.

8. The foam dispenser according to claim 1, wherein:

f. the porous member is substantially noncompressible, g. the conduit means includes a non-porous tubular member having one end extending into said porous member and the other end extending into the container, and h. the flow directing means includes movable valve means mounted in the conduit means and cooperating with the means permitting an air flow into the air bag means and actuated outwardly when the container is pressurized to direct fluid transversely into the porous member and actuated inwardly when the container is depressurized.

9. A foam dispensing device comprising:

a flexible container for holding a foamable liquid having a discharge port, b. a porous member separating the area adjacent said discharge port and the inside of said container, c. air bag means disposed within the container for holding an air supply isolated from said liquid, d. conduit means communicating between the porous member and the air bag means, and permitting an air flow into the air bag means, said conduit means extending at least substantially through said porous member and including a first opening leading to the porous member and a second opening leading to the area adjacent said discharge port, and e. a flow directing means associated with the conduit means for directing air from inside the air bag means through the conduit means and into the porous member while the foamable liquid is being directed into the porous member from inside of said container during pressurization of the container and including valve means associated with said second opening to substantially close said second opening during said pressurization.

10. The foam dispenser according to claim 9, wherein:

f. the valve means includes a ballcheck operatively engageable with projection means situated on the inside of said conduit means the ballcheck and the projection means cooperating to permit air flow around said ballcheck when the ballcheck is substantially in contact with said projection means.

11. A foam dispensing device comprising:

a. a flexible container for holding a foamable liquid and air, said container having a discharge port, b. a porous member separating the area adjacent said discharge port and the inside portion of said container, c. a conduit means communicating between the inside portion of said container and the porous member, including means permitting an air flow into the container, and d. a flow directing means associated with the conduit means for directing one of said fluids from inside the container through the conduit means into the porous member, while the other of said fluids, is being directed into the porous member from inside of said container by a different path during pressurization of the container.

12. A foam dispenser according to claim 11, wherein:

e. the flow directing means includes means substantially precluding direct longitudinal fluid flow from the conduit means through said porous member.

13. A foam dispenser according to claim 11, wherein:

e. the conduit means extends longitudinally at least partly through said porous member and communicates transversely with said porous member, and f. the flow directing means includes means directing fluid flow from said conduit means transversely into said porous member.

14. A foam dispenser according to claim 11, wherein:

e. bag means is disposed within the container for holding one of said fluids in isolated relation from the other of said fluids, and f. the conduit means communicates between the porous member and the bag means permitting fluid flow from the bag means into the porous member.

* * * * *